US006339377B1

(12) United States Patent
Naka et al.

(10) Patent No.: US 6,339,377 B1
(45) Date of Patent: Jan. 15, 2002

(54) ARTICLE SURVEILLANCE SECURITY SYSTEM WITH SELF-ALARM

(75) Inventors: Katsufumi Naka; Hitoshi Hasegawa, both of Mie (JP)

(73) Assignee: Kojin Co., Ltd., Mie (JP)

( * ) Notice: Subject to any disclaimer, the term of this patent is extended or adjusted under 35 U.S.C. 154(b) by 0 days.

(21) Appl. No.: 09/600,778

(22) PCT Filed: Nov. 22, 1999

(86) PCT No.: PCT/JP99/06498

§ 371 Date: Jul. 21, 2000

§ 102(e) Date: Jul. 21, 2000

(87) PCT Pub. No.: WO00/31703

PCT Pub. Date: Jun. 2, 2000

(30) Foreign Application Priority Data

Nov. 24, 1998 (JP) ..... 10-331798
Jun. 7, 1999 (JP) ..... 11-160283

(51) Int. Cl.[7] ..... G08B 13/14

(52) U.S. Cl. ..... 340/572.1; 340/572.4; 340/572.5

(58) Field of Search ..... 340/10.2, 10.33, 340/10.34, 10.5, 572.1, 572.4, 572.5, 572.7, 572.8, 571, 568.1; 235/462.27, 462.46, 472.01, 385

(56) References Cited

U.S. PATENT DOCUMENTS 5,353,011 A * 10/1994 Wheeler et al. ..... 340/572.4
5,463,376 A * 10/1995 Stoffer ..... 340/572.4
5,680,106 A * 10/1997 Schrott et al. ..... 340/572.1
5,689,239 A * 11/1997 Turner et al. ..... 340/10.3
5,955,951 A * 9/1999 Wischerop et al. ..... 340/572.8
6,232,870 B1 * 5/2001 Garber et al. ..... 340/572.4
6,232,878 B1 * 5/2001 Rubin ..... 340/572.1

FOREIGN PATENT DOCUMENTS

JP 4-242892 8/1992
JP 8-44963 2/1996

* cited by examiner

*Primary Examiner*—Van T Trieu
(74) *Attorney, Agent, or Firm*—Armstrong, Westerman, Hattori, McLeland & Naughton, LLP

(57) ABSTRACT

An article surveillance security system with self-alarm operates at 6 through 10 MHz as a central frequency, receives a swept low level radio wave within ±5 through 15% from the central frequency, and sounds the alarm. It includes a tuning circuit (1) tuning to the central frequency, and a differential amplifier (2) for amplifying and detecting the output of the tuning circuit. The load resistance (R1) of the differential amplifier is set to 3 through 5 MΩ, and the operating current of the differential amplifier is set to 3 $\mu$A or less. The base-emitter of the amplification/detection transistor (Tr1) of the differential amplifier are connected to the base-emitter of another diode-connected transistor (Tr2) to stabilize a bias drift by temperature. Thus, a receiving circuit of an article surveillance security system with self-alarm (tag) is realized with ability having a power supply of approximately four-year durability, stably operating with a very low level radio wave at 8.2 MHz, and suppressing external noise, especially a malfunction at a frequency band of a mobile telephone.

11 Claims, 12 Drawing Sheets

ARTICLE SURVEILLANCE SECURITY SYSTEM WITH SELF-ALARM

This application is the national stage under 35 U.S.C. 371 of PCT/JP99/06498, filed on Nov. 22, 1999.

TECHNOLOGY AREA

This invention relates to an article surveillance security system with self-alarm to be attached to articles or goods so that they can be protected against shoplifting in a common retail shop, etc.

BACKGROUND OF THE INVENTION

A conventional article surveillance security system contains a passive paper tag without a built-in power supply. The paper tag is attached to articles or goods, reacts and sounds an alarm at an entrance gate when it is taken out of a retail shop without permission, that is to say when it is passing by a transmitter mounted at an entrance gate, etc. of the shop, Thereby it protects the articles or goods against shoplifting. Although a passive paper tag is cheap in cost, it cannot correctly distinguish the shoplifter when a plurality of shoppers simultaneously pass by the gate. Therefore, it is hard to catch the shoplifter in flagrante delicto. In addition, if a shoplifter tries to run away from the alarm, a shopman cannot successfully catch the shoplifter because the shopman cannot immediately locate the paper tag by which an alarm is sounded.

The above described problem has been solved by an article surveillance security system with self-alarm which contains a power supply, and makes a tag itself sounding an alarm when it receives an radio wave from a transmitter mounted at an entrance gate of a shop. For example, in the case of a CD(compact disk), the article surveillance security system with self-alarm of this type is provided with a clear case 9 made of synthetic resin, a circuit substrate 10, an alarm operation switch 11, and a buzzer 12 as shown in FIG. 11. The clear case 9 contains a cassette 8 storing a CD(compact disk). The buzzer 12 is controlled by the circuit substrate 10 and the alarm operation switch 11. If the cassette 8 does not exist in the clear case 9, then the alarm operation switch 11 sounds the buzzer. Otherwise, if the article surveillance security system with self-alarm passes through the gate, the circuit sounds the buzzer. In a shop, the cassette 8 containing a CD (compact disk) is put in the clear case 9 with the article surveillance security system with self-alarm, and displayed. When a salesperson sells the CD to a shopper, the salesperson first sets the buzzer 12 in an inactive state, then takes the cassette 8 out of the clear case 9, and delivers the CD to the shopper in exchange for charge. The article surveillance security system with self-alarm can be repeatedly used after the cassette 8 has been taken out.

In the above described article surveillance security system with self-alarm, when a shopper takes out the cassette 8 illegally from the clear case 9 with the article surveillance security system with self-alarm, the alarm operation switch 11 detects the absence of the cassette 8 in the clear case 9 and issues an alarm instruction to the buzzer 12 to make it sounding upon receipt of the alarm instruction. Thus, a salesperson can be informed that the cassette 8 has been illegally taken out of the clear case 9. In addition, if a shopper tries to take out a cassette 8 contained in a clear case 9 with an article surveillance security system with self-alarm as it is, the receiving circuit of the article surveillance security system with self-alarm receives a signal from a transmitting circuit provided at the entrance gate, etc., and issues an alarm instruction to the buzzer 12. The buzzer 12 receives the alarm instruction and sounds. Thus, the salesperson can be informed that the compact disc is being illegally taken out of the shop.

Furthermore, as shown in FIG. 12, a tag 15 of an article surveillance security system can also be individually attached to articles or goods by using a tape, etc. in other embodiment. This type of tag has been already suggested by the same applicant. The above described case also contains the circuit of the article surveillance security system with self-alarm. In FIG. 12, 16 is a LED(light emission diode).

FIG. 13 is a detailed analytic view of FIG. 12. FIG. 13(*a*) is a view from the bottom of a tag case 15 shown in FIG. 12. FIG. 13(*b*) is a view of the printed substrate contained in the tag case, when it is taken out of the tag case. FIG. 13(*c*) is a view of FIG. 13(*a*) without the bottom plate.

In FIG. 13(*c*), 31 is a display window of the LED(light emission diode) corresponding to the LED(light emission diode) 16 shown in FIG. 12. In FIG. 13(*c*), there are a plastic case 18, which has a shape of a turned boat as shown in FIG. 12, a printed substrate 19 stored in the case, a buzzer 20, a battery 21 , a long hole 22 made in the printed substrate, a switch 23, a male lock material 24, a female lock material 25, a lock pin 26, a bottom plate 27, a snap switch 28, a hole 29 in the bottom plate, and an actuating chip 30 of the snap switch 28. The above described self-alarm tag case has the shape of a turned boat of 9 cm long and 2 cm wide. The actuating chip 30 of the snap switch 28 projected from the hole in the bottom plate 29 of the case is pressed against articles or goods, and is fixed to the articles or goods by using a tape, etc. In this type of tag, the buzzer does not sound while the actuating chip is pressed against articles or goods. However, if the tag is illegally removed from the articles or goods, the operation chip 30 is turned ON, and accordingly the buzzer sounds. Additionally, in this type of tag, if articles or goods is illegally taken out of the entrance gate without permission before releasing a lock, the tag receives a radio wave from the transmitter provided at the entrance gate, thereby sounding the buzzer.

Since articles or goods sound an alarm by itself by using the article surveillance security system with self-alarm, the shoplifter can be easily specified, and the shoplifter can be more effectively caught in flagrant than using the above described passive paper tag. However, the paper tag is 10 through 60 yen apiece while the self-alarm tag is 400 through 600 yen apiece. Therefore, the self-alarm tag is much more expensive, and is hard to be used in large quantities. The paper tag is commonly a bar code printed paper containing a printed tuning circuit comprising LC, which is operated at a frequency of 8.2 MHz. A frequency of 8.2 MHz is appropriate for the above described LC to be made in size of 2 through 3 cm in length and width. Another paper tag operated at a frequency of 58 KHz has also become popular. The above described LC circuit at 58 KHz is too large to be practical, and the paper tag at 58 KHz uses a special capacitor. In general, a higher-quality function can be obtained at a low frequency of 58 KHz. However, since a generally used LC circuit can be adapted at a frequency of 8.2 MHz, the paper tag at 8.2 MHz is more costly.

The above described self-alarm tag is already known to be operated at frequencies 22 KHz, 37.5 KHz, and 31.5 KHz. However, if the self-alarm tag is operated at the same frequency as that of the above described passive paper tag, then the transmitter for the paper tag can be used simultaneously for the self-alarm tag as it is. Therefore, both type of tags can be easily used in the passive paper tag system which has been widely used. That is, the expensive self-alarm tag has a strong effect for protecting articles or goods against shoplifting only by using even one in ten tags. Accordingly, if the passive paper tag and self-alarm tag can be commonly used at the same frequency, then the transmitter provided at the entrance gate, etc. of a shop can also be commonly used, thereby contributing to be popularized.

That is, it is desired that the above described self-alarm tag is designed for 58 KHz or 8.2 MHz which is the common frequency with that of the paper tag. However, the radio wave emitted from the transmitter has a very low power emission of radio wave according to the rule of the Radio Wave Law, and the power supply is a small lithium ion battery (3V) which should work for about 4 years as a useful tag. Therefore, the operating current in a tag circuit should be 1 or 2 $\mu$A. As a result, a tag at the frequency of 58 KHz can be barely realized, but it is difficult to design a tag at the frequency of 8.2 MHz, and no practical products have been successfully realized.

That is, although it is necessary to reduce an operating current flowing through a transistor such as 1 or 2 $\mu$A by setting the load resistance at a high value of 3 through 5 MΩ. However, with the above described settings, the operating current becomes too low, and a transistor cannot sufficiently amplify the signal at the frequency of 8.2 MHz. Simultaneously, as the impedance becomes high through the high load resistance, thereby it easily generates noise.

Furthermore, when an operating point moves even slightly by the fluctuation of an environmental temperature, it is difficult to keep a stable operation of the circuit because of the original tight design.

On the other hand, the self-alarm tag operating at a frequency of 58 KHz is a useful tag, but the passive paper tags operating at a frequency of 58 KHz and the passive paper tags operating at a frequency of 8.2 MHz occupy an equal market share. Therefore, as a shop already provided with the 8.2 MHz passive tag system does not require additional equipment investment if it adopts the 8.2 MHz self-alarm tag, there is a strong demand for the 8.2 MHz self-alarm tag.

However, although there have been a number of developments for the above described self-alarm tag, the above described problems have not been solved at a frequency of 8.2 MHz, and no successful products have been disclosed yet. Under the circumstance, this invention has been developed to generate an effective receiving circuit, specifically to successfully develop an self-alarm tag stably operating at a frequency of 8.2 MHz.

SUMMARY OF THE INVENTION

The object of this invention is to provide a receiving circuit of an article surveillance security system with self-alarm or a self-alarm tag which has a power supply of approximately four-year durability, and stably operates with a very low level radio wave at a conventionally inapplicable frequency band (for example, 8.2 MHz).

In addition, the object of the invention is providing a receiving circuit of an article surveillance security system with self-alarm or a self-alarm tag having a power supply of approximately four-year durability, stably operating with a very low level radio wave at a conventionally inapplicable frequency band (for example, 8.2 MHz), and suppressing external noise, especially due to a malfunction at a frequency band used in a mobile telephone.

The circuit of the article surveillance security system with self-alarm according to this invention sets from 6 through 10 MHz as a central frequency, receives a low level radio wave swept within ±5 through 15% from the central frequency, and sounds the alarm. It includes a tuning circuit tuning to the central frequency, and a differential amplifier for amplifying and detecting an output signal of the tuning circuit. The load resistance of the differential amplifier is set to from 3 through 5 MΩ, and the operating current of the differential amplifier is set to 3 $\mu$A or less. The base-emitter of the amplification/detection transistor (Tr1) of the differential amplifier are connected to the base-emitter of another diode-connected transistor (Tr2) of the differential amplifier in order to stabilize a circuit operation against a bias drift by temperature.

Furthermore, the output of the differential amplifier is connected to a charge/discharge circuit including a resistor and a capacitor and a comparison circuit through a direct-coupled amplifier in series, and it is detected that receiving pulses corresponding to the sweep frequency have been supplied predetermined times, thereby removing the non-successive receiving noise around the central frequency. Otherwise, the output of the differential amplifier is supplied to a microcomputer through the direct-coupled amplifier after AD(analog-digital) conversion, and it is detected that receiving pulses corresponding to the sweep frequency have been supplied predetermined times, thereby removing the non-successive receiving noise around the central frequency.

In addition, the article surveillance security system with self-alarm according to this invention sets the central frequency of 6 through 10 MHz, and sounds the alarm when receiving a low level radio wave swept within the range of ±5 through 15% from the central frequency, and it includes a tuning circuit for the central frequency; an inductance inserted in series with the signal path having low impedance at the above described frequency of 6 through 10 MHz, and high impedance at 1 GHz or more; and a first stage amplifier having high load resistance for amplifying and detecting the output of the tuning circuit supplied through the inductance.

Furthermore, the 1005 size is used as a unit of the resistance, the impedance, etc of the above described circuit, so that the stray impedance at a frequency of 1 GHz or more in the input circuit, the bias circuit, and the load circuit of the differential amplifier can be as small as possible. The shield effect for external noise can be improved by widening an earth pattern and a pattern of the power supply line of the above described circuits on the printed substrate.

In addition, in this embodiment the first stage amplifier is a differential amplifier, and the load resistance of the differential amplifier is 3 through 5 MΩ so that the operating current of the differential amplifier can be 3 $\mu$A or less, and the base-emitter of the amplification/detection transistor (Tr1) of the differential amplifier are connected to the base-emitter of another diode-connected transistor (Tr2) as a pair to the transistor (Tr1) of the differential amplifier to stabilize against bias drift by temperature. The output of the differential amplifier is connected to a charge/discharge circuit including a resistor and a capacitor and a comparison circuit through a direct-coupled amplifier, and it is detected that receiving pulses corresponding to the sweep frequency have been supplied predetermined times, thereby removing the non-successive receiving noise around the central frequency.

Otherwise, the output of the differential amplifier is supplied to a microcomputer through the direct-coupled amplifier after AD conversion, and the microcomputer detects that receiving pulses corresponding to the sweep frequency have been supplied predetermined times, thereby removing the non-successive receiving noise around the central frequency. In addition, the central frequency is 8.2 MHz, the sweep range can be ±10%, and the sweep frequency is 50 through 80 Hz.

DESCRIPTION OF THE PREFERRED EMBODIMENT

The embodiments of this invention are described below by referring to the attached drawings.

Figure 1:
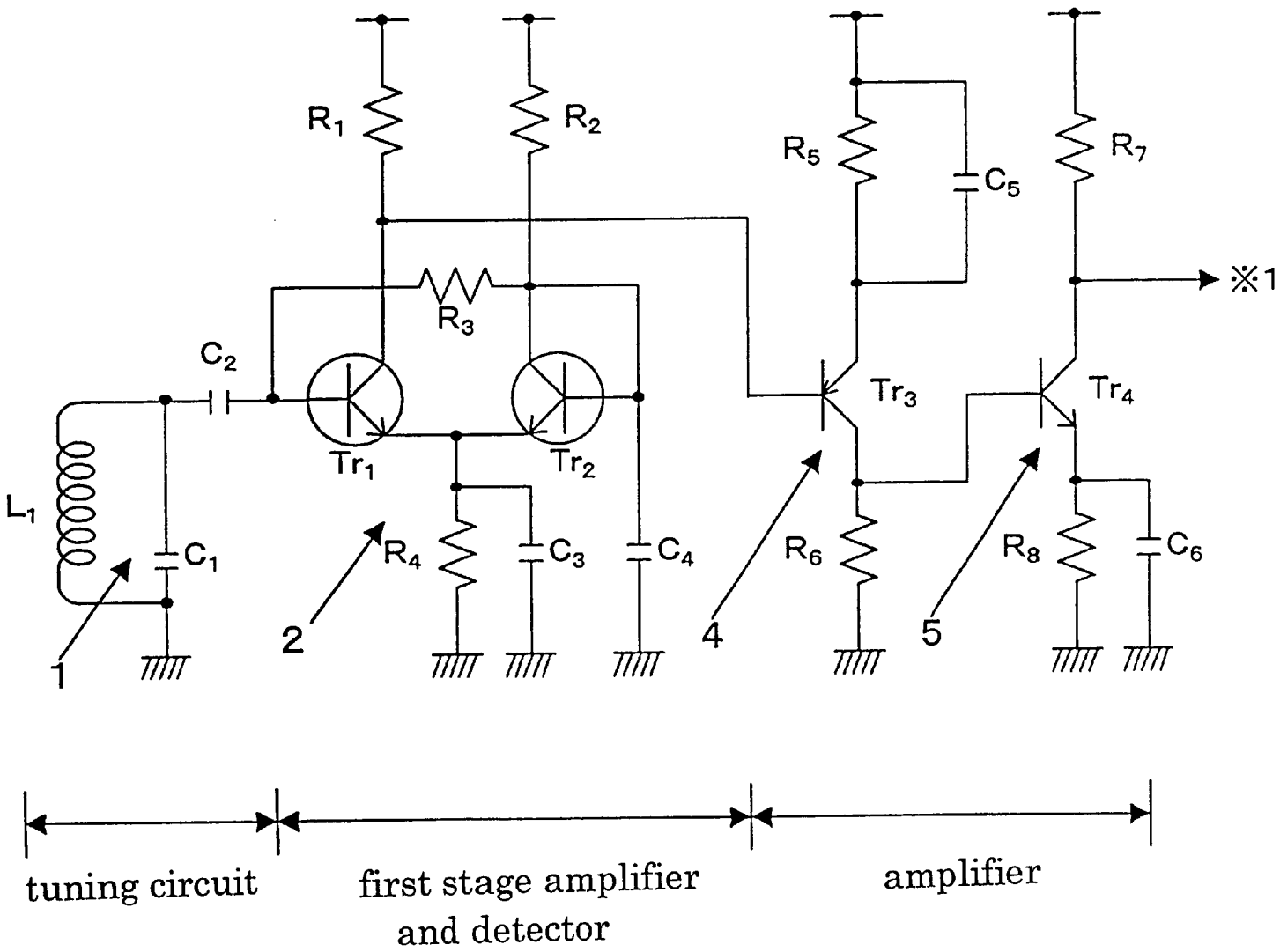
FIG. 1 shows the receiving circuit of the article surveillance security system with self-alarm according to this invention.

FIG. 1 shows the receiving circuit of the article surveillance security system with self-alarm according to this invention. In FIG. 1, a tuning circuit 1 is comprising an L1 and a C1. In this embodiment, the central frequency is 8.2 MHz. The above described L1 and C1 can be realized by a general-purpose printing circuit. The frequency of the radio wave emitted from the transmitter is swept by ±10% from the 8.2 MHz so that the operation of the receiving circuit can be surely performed although the radio wave is emitted from the transmitter at very low level and the tuning frequency of the tuning circuit deviates more or less due to the uneven production process of tags. Since the sweep frequency is 50 through 80 Hz, it is assumed that the frequency modulation is applied to 8.2 MHz carrier by 50 through 80 Hz signal. The received radio wave is supplied to a first stage amplification/detection circuit 2 through the tuning circuit 1.

The first stage amplification/detection circuit 2 is formed as a variation of the differential amplifier. A transistor Tr2 which is the pair of an amplification/detection transistor Tr1 is diode-connected, and the diode-connected transistor Tr2 is connected in parallel between a base and an emitter of the Tr1.

Thus, since the base bias of the Tr1 depends on the voltage between the base and the emitter of the Tr2, the fluctuation of the bias of the Tr1 by temperature can be compensated for. That is, although the break-down voltage between the base and the emitter of the Tr1 fluctuates depending on temperature, a constant bias is applied. The resistor R3 is inserted to stabilize a circuit, but is not a must. In addition, since the operating current flows at very low level to take a long life of battery, the voltage drop by the resistor R3 is much lower than the voltage between the base and the emitter of the transistor TR1 and therefore it can be ignored.

Figure 2:
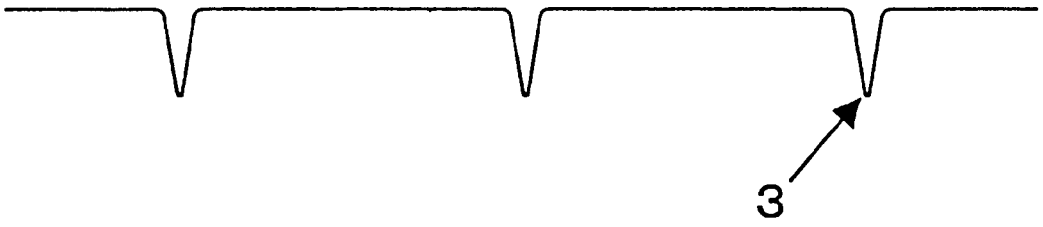
FIG. 2 shows the output waveform of the differential amplifier 1 of the receiving circuit shown in FIG. 1.

In the collector of the amplification/detection transistor Tr1 of the differential amplifier, a signal as shown in FIG. 2 is generated. Since the power consumption is considerably suppressed for the first stage amplification circuit, the load resistor R1 of the Tr1 indicates a high value of 3 through 5 MΩ, and therefore the majority carrier wave of the output at the collector of the Tr1 at the 8.2 MHz band is negatively fed back to the input terminal (the base of the TR1) through a stray capacitance between the base and the collector of the Tr1. As a result, a component at 8.2 MHz carrier wave can hardly be generated at the output terminal of the collector of the TR1.

That is, the first stage amplification circuit generates merely modulation signal components at 50 through 80 Hz at the output terminal. Accordingly, it is rather a detector than an RF amplifier. In addition, no satisfactory amplification can be performed using a low operation current as described above, no sine waves are generated, and only the upper portion of a sine wave such as shown in the C class amplification mode can be generated at the output terminal as shown in FIG. 2.

Therefore, if the carrier wave at the above described 8.2 MHz is a CW (continuous wave), then the output is a continuous output, that is, only a small direct current component which can be hardly detected. However, the frequency of a transmitter for a paper tag is fortunately swept within a predetermined range ±10% to absorb the fluctuation of the tuning frequency of the paper tags as described above. Accordingly, the sweep characteristic around the central frequency (8.2 MHz) is generated at the output terminal in the form of the pulse 3 corresponding to the above described tuning characteristic as shown in FIG. 2.

Thus, since the first stage amplification circuit performs a special operation at the operation limit, the operation becomes unstable without the above described bias temperature compensation. That is, under the conditions such as with a very low level radio wave, and in the special operation state in the special usage in which the consumption of the power supply is suppressed, this invention is characterized to provide a circuit acceptable somehow as a self alarm tag especially through the above described temperature compensation.

Figure 3:
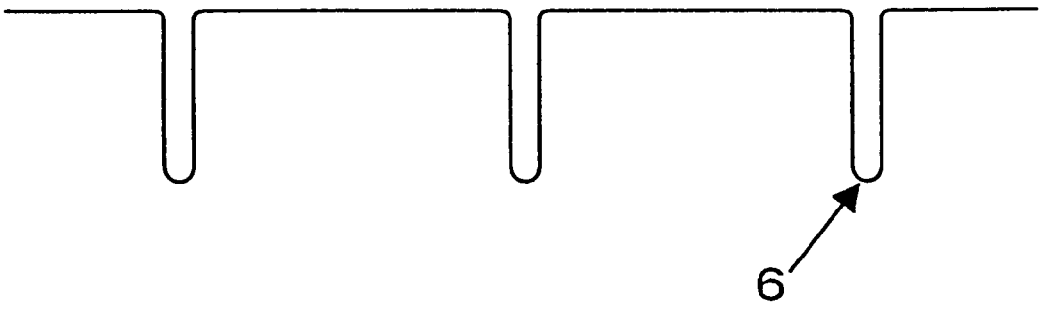
FIG. 3 shows the output waveform of the receiving circuit shown in FIG. 1.
Figure 4:
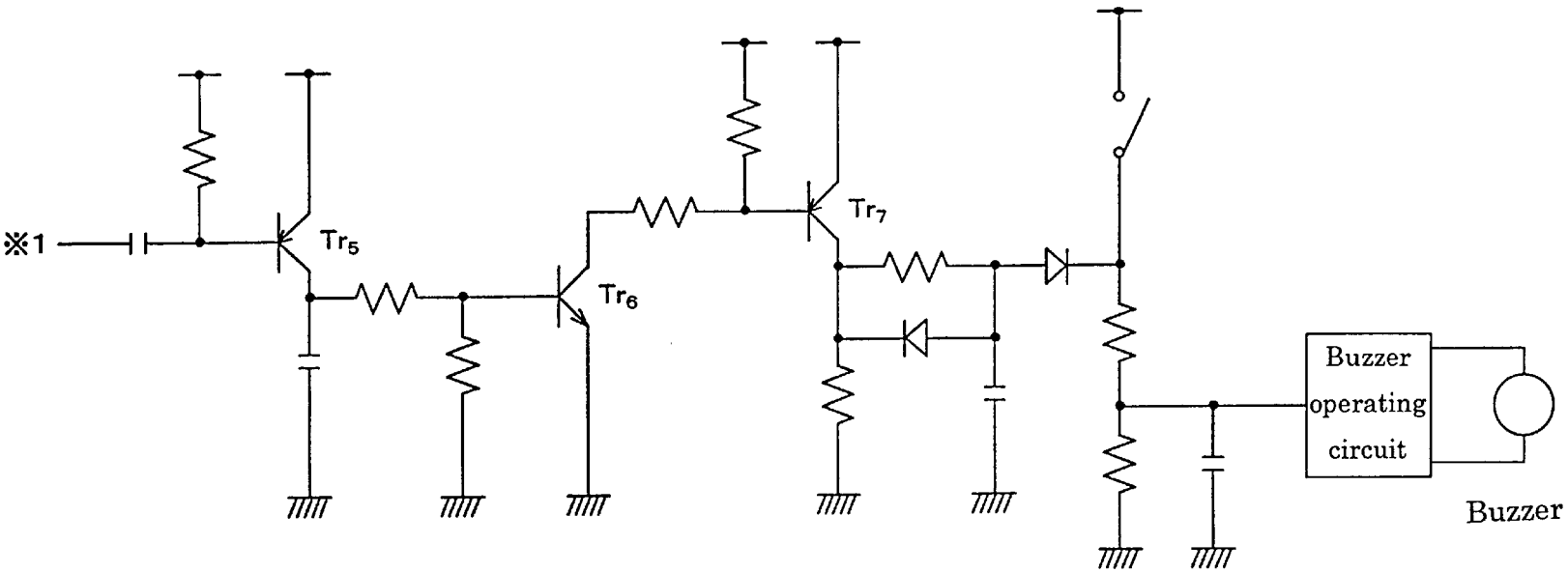
FIG. 4 shows an example of the noise removal circuit connected to the receiving circuit of the article surveillance security system with self-alarm according to this invention.
Figure 5:
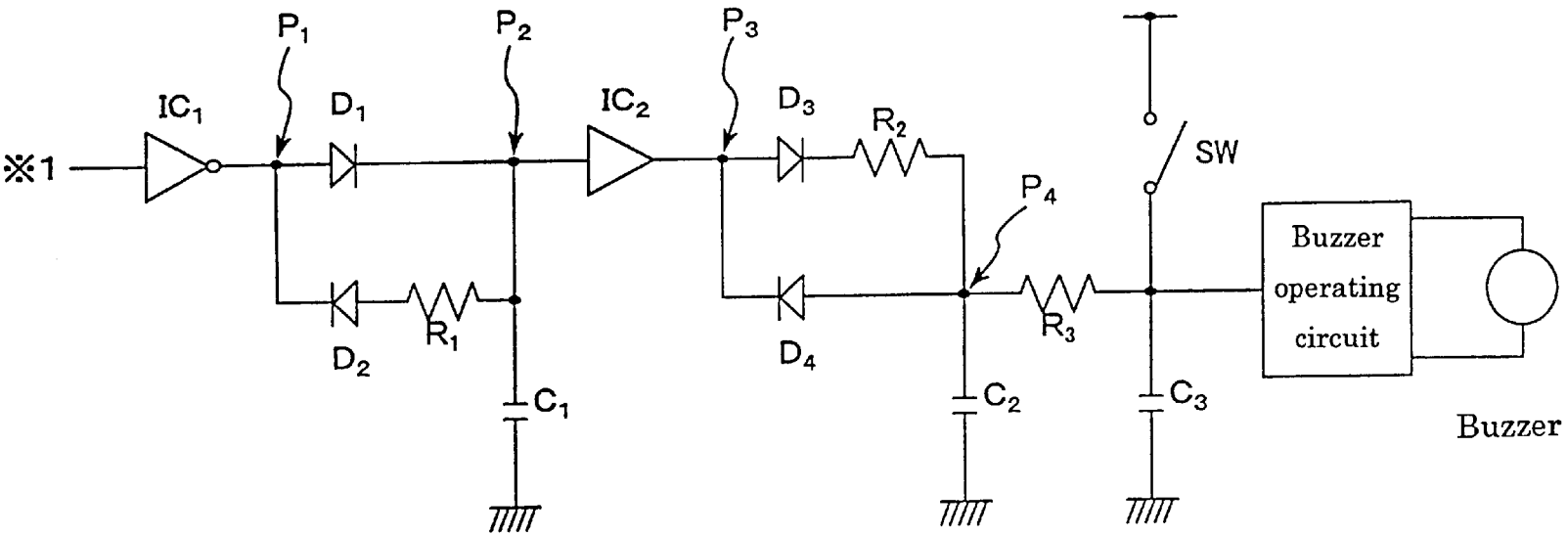
FIG. 5 shows another embodiment of the noise removal circuit connected to the receiving circuit of the article surveillance security system with self-alarm according to this invention.

The output of the differential amplifier is operated in the form of almost DC (direct current) amplification (because of low frequency around 80 Hz), and the output as shown in FIG. 3 is obtained through the second direct-coupled amplification 4 and 5 in FIG. 1. As described above, if the sweep output frequency is, for example, 80 Hz, the output becomes the pulse row 6 at 2 millisecond intervals. The pulse row 6 is supplied to the noise removal circuit shown in FIG. 4 or 5. FIG. 4 and 5 show equivalent circuits. FIG. 4 shows the noise removal circuit using a transistor. FIG. 5 shows the circuit using an IC.

Figure 11:
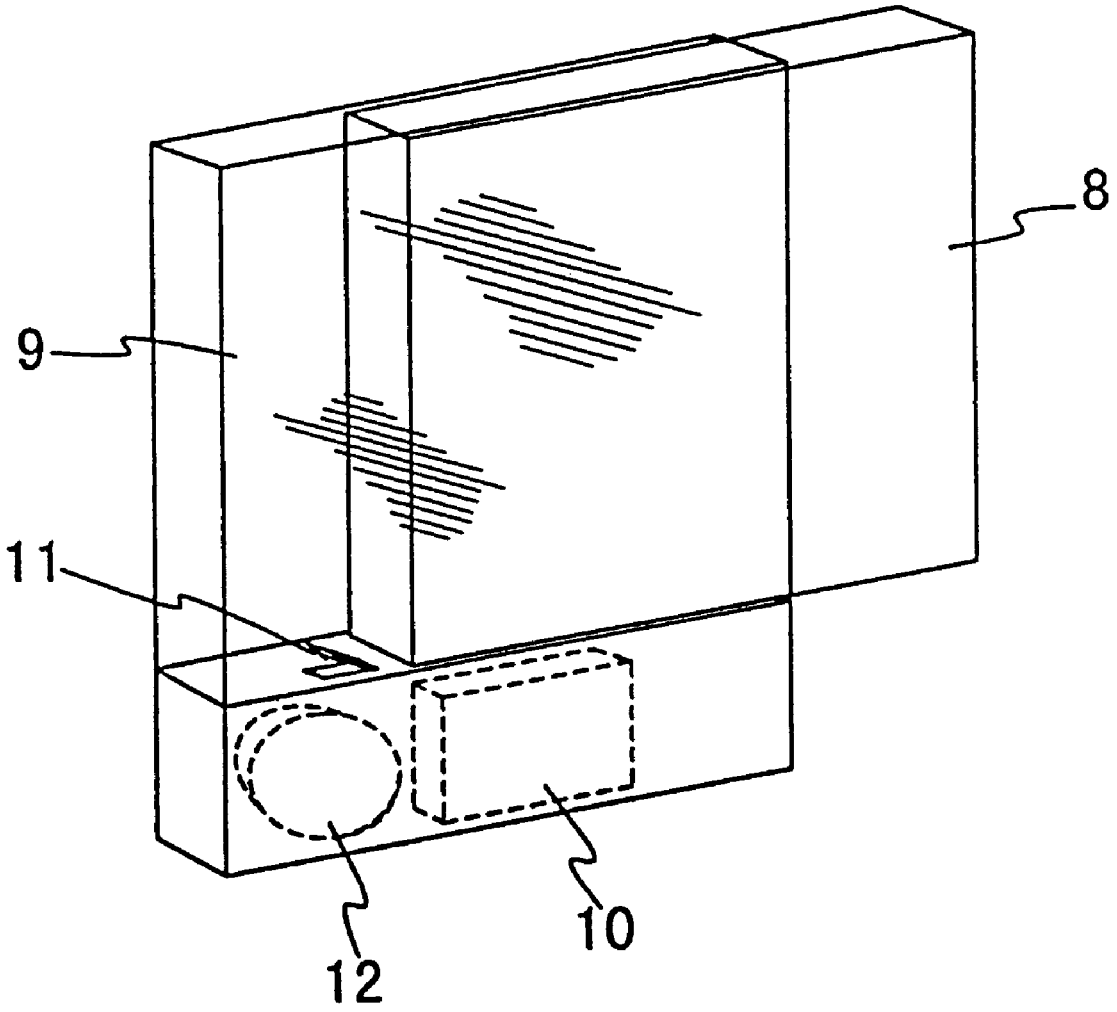
FIG. 11 is an entire view of an example of the article surveillance security system with self-alarm.
Figure 12:
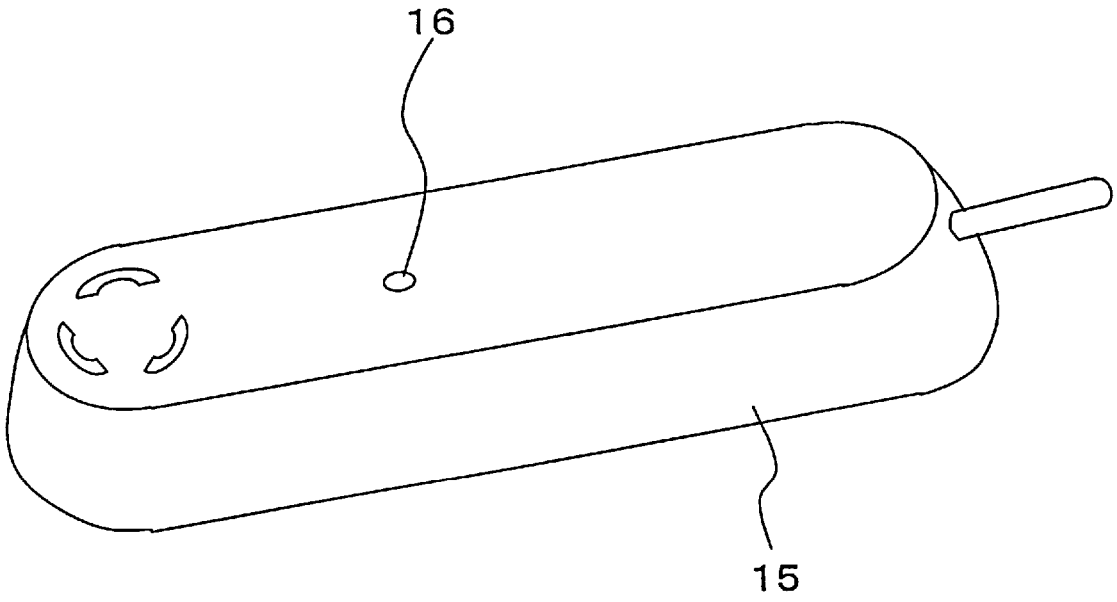
FIG. 12 is another entire view of an example of the article surveillance security system with self-alarm.
Figure 13:
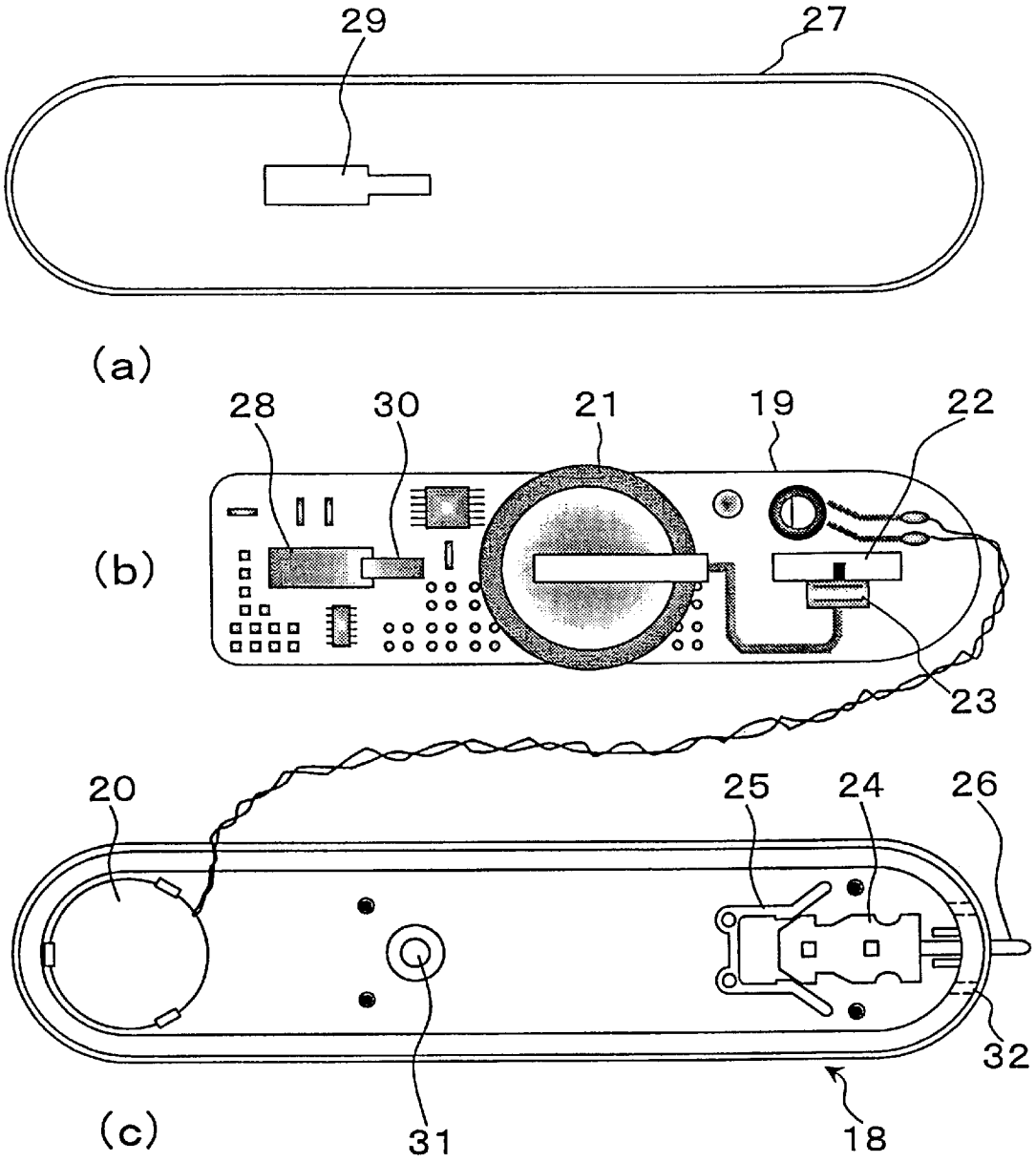
FIG. 13 shows in detail the inside of the article surveillance security system with self-alarm shown in FIG. 12.

The operation of the circuit shown in FIG. 5 is described below. An IC1 is an inverter, a Schmitt trigger buffer, etc. An IC2 is a buffer, a Schmitt trigger buffer, etc. A switch SW in FIG. 5 is the alarm operation switch such as switch 11 in FIG. 11. In FIG. 5, an resistance R3 and a capacitor C3 are circuits for removal of high frequency noise having a small time constant, but are not a must. In FIG. 5, the output of the IC1 is P1 shown in FIG. 6. The capacitor C1 is charged with the pulse 7 through a diode D1. Simultaneously, the electric charge of the capacitor C1 is discharged through an resistance R1 and a diode D2 during the pause period in which a pulse 7 is not supplied.

Figure 6:
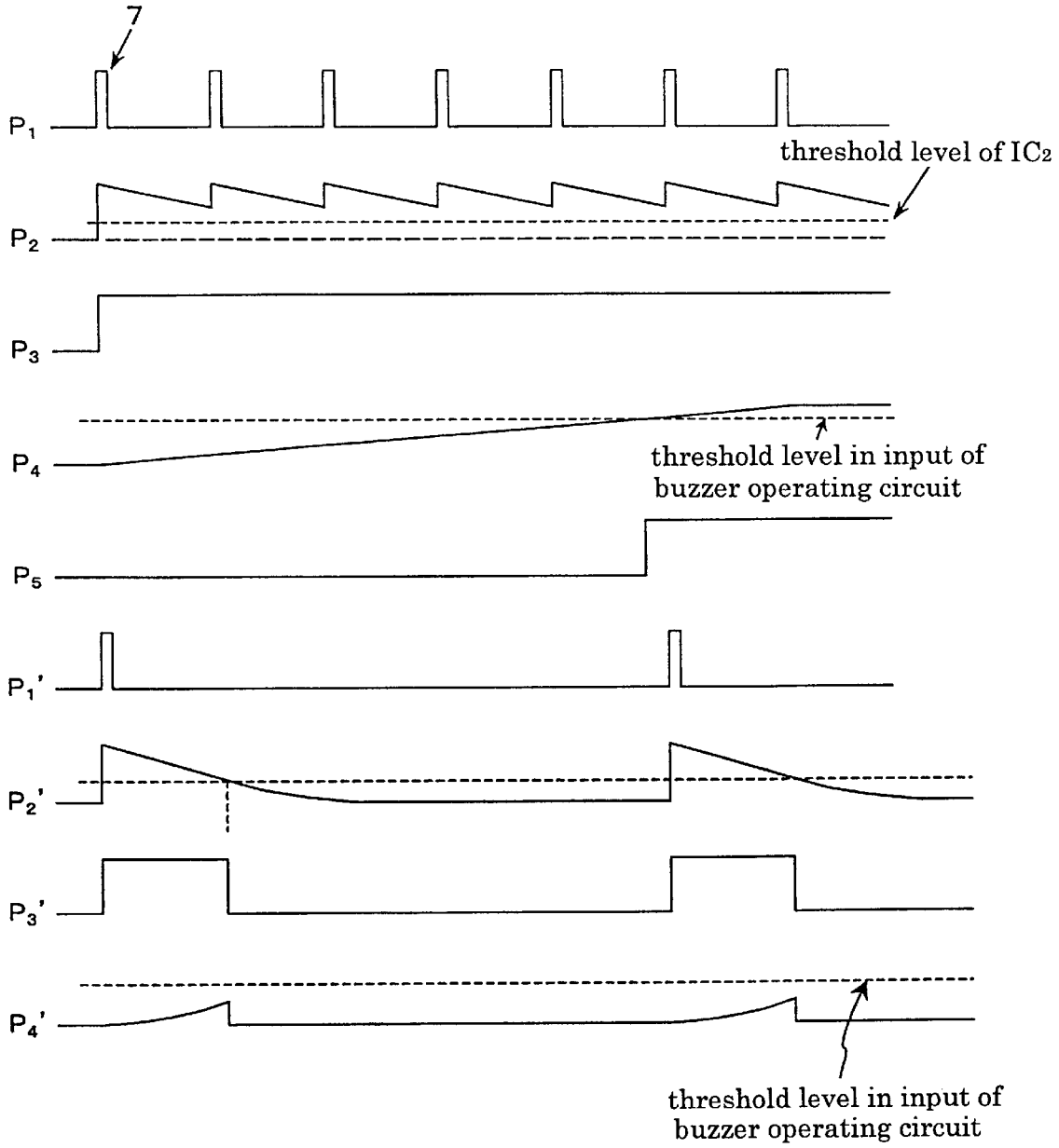
FIG. 6 shows the waveform at each point shown in FIG. 5.

The output level of the capacitor C1 indicates a value equal to or higher than the threshold level of the IC2 because of the difference between the above-mentioned charge and discharge time constant as long as the receiving pulse 7 continues to be supplied, which is shown by the waveform P2 in FIG. 6. The output of the IC2 is represented by the waveform P3 shown in FIG. 6. The waveform P3 passes through the diode D3 and resistance R2, and is gradually charged for the capacitor C2, thus the output of capacitor C2 turns the waveform P4 shown in FIG. 6. When this waveform P4 enters the buzzer driving circuit, and exceeds the threshold level of the buzzer driving circuit, the waveform P5 is generated, thereby sounding the buzzer. The buzzer driving circuit comprises an oscillator for sounding the buzzer, a transformer for boosting a piezo-electric buzzer for higher alarm sound, and a driving circuit.

Described above are the operations performed when a normal signal is received in a normal operation state, and the above described charge/discharge circuit is provided to suppress erroneously sounding the buzzer in response to accidental noise, noise from a mobile telephone, etc. That means, as the consumption of an electric current in the receiving circuit is considerably reduced, it is necessary to operate the circuit using from 1 through 3 $\mu$A in the standby mode, and therefore the impedance of the circuit is high, it is inevitably subject to the influence of noise.

Since the noise from a mobile telephone, etc. is supplied only incidentally, it has a long pulse period such as the P1' shown in FIG. 6 as compared with that of the P1. Therefore, the electric charge of the capacitor C1 corresponding the waveform P2 soon indicates a level equal to or lower than the threshold level of the IC2. As a result, the output of the IC2 is not a continuous output such as the P3. On the contrary, an output as an intermittent pulse such as P3' is generated, as a result the output of electric charge P4' of the capacitor C2 does not exceed the threshold level of the buzzer circuit, and no buzzer driving output is generated. Since the circuit operation shown in FIG. 4 is identical with that shown in FIG. 5, the description about operation is omitted here.

As described above, not only the noise from a mobile telephone, but also an accidental click noise and long-period noise can be removed. However, it has proved that an erroneous operation cannot be perfectly suppressed by the noise removal circuit as suggested above mainly because the high load impedance of the first stage amplifier of the circuit is easily affected by noise, and because an erroneous operation by a mobile telephone operating at a high frequency of 1 GHz or more cannot be successfully suppressed in an environment (in a shop, etc.) of the above described tags.

Based on the above described background, this invention has added some more contrivances to prevent erroneous operations by the noise from a mobile telephone operating at a high frequency of 1 GHz or more.

Described below is the noise-erroneous operation protection circuit.

Figure 7:
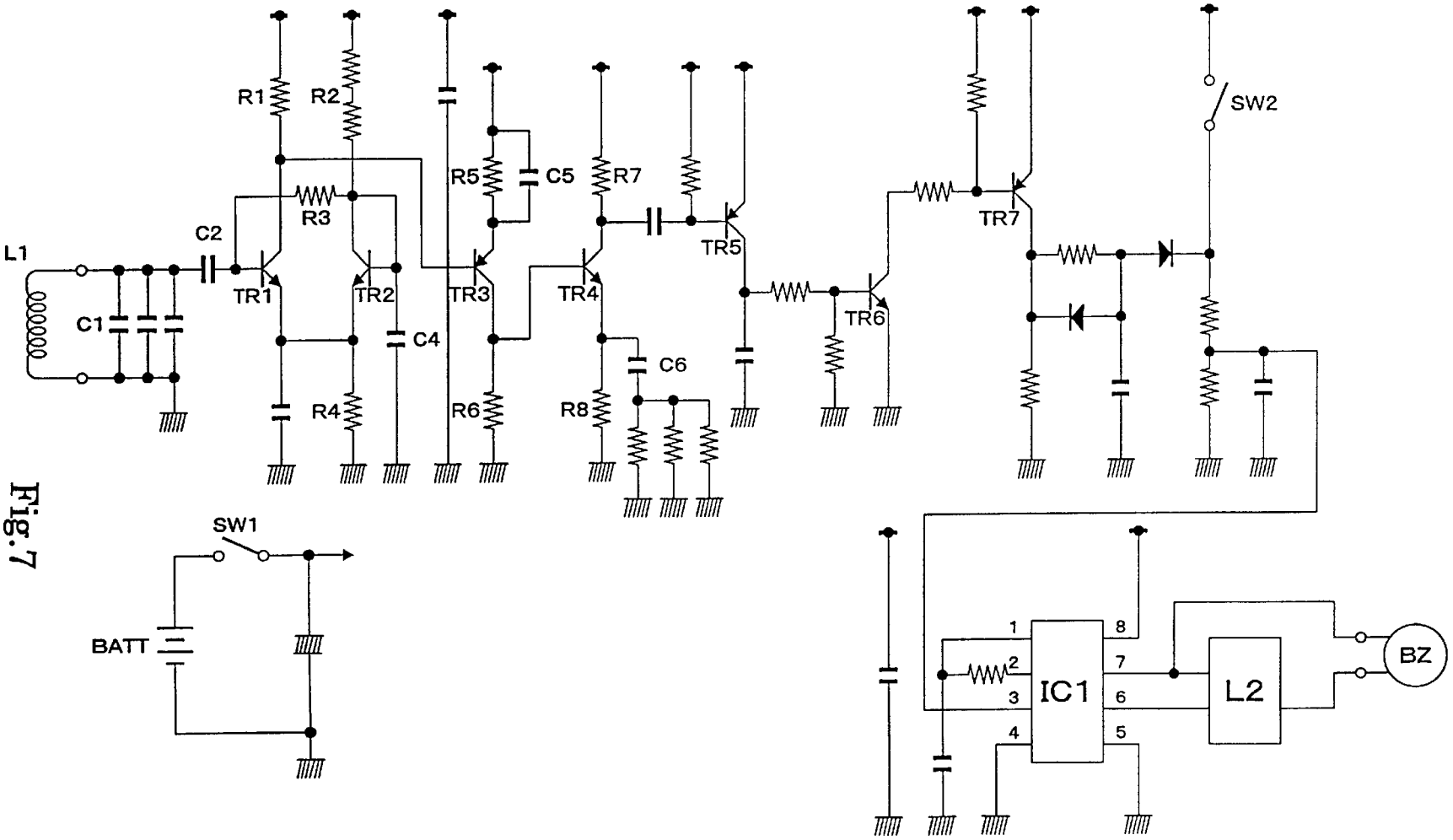
FIG. 7 shows the realized circuit design of the receiving circuit used in the article surveillance security system with self-alarm according to this invention.
Figure 8:
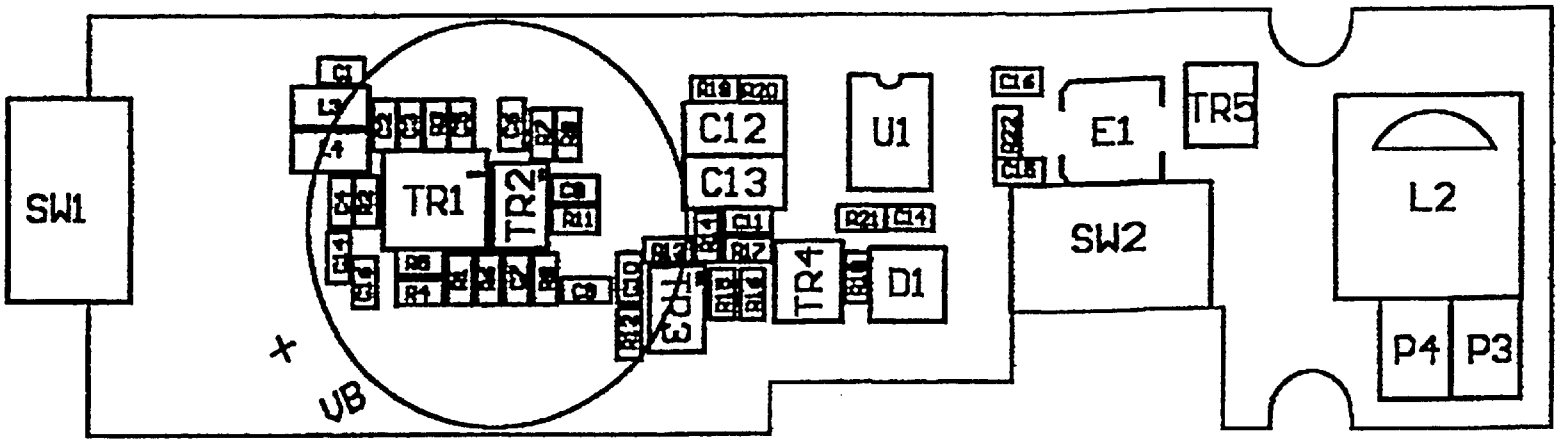
FIG. 8 shows an disposition of the installation circuit shown in FIG. 7 on the printed substrate (50 mm×16 mm)

FIG. 7 shows the realized circuit design of the receiving circuit shown as FIG. 1 and FIG. 4 used in the above described article surveillance security system with self-alarm according to the original suggestion. FIG. 8 shows a disposition of an installation circuit on the printed substrate (50 mm×16 mm).

Figure 9:
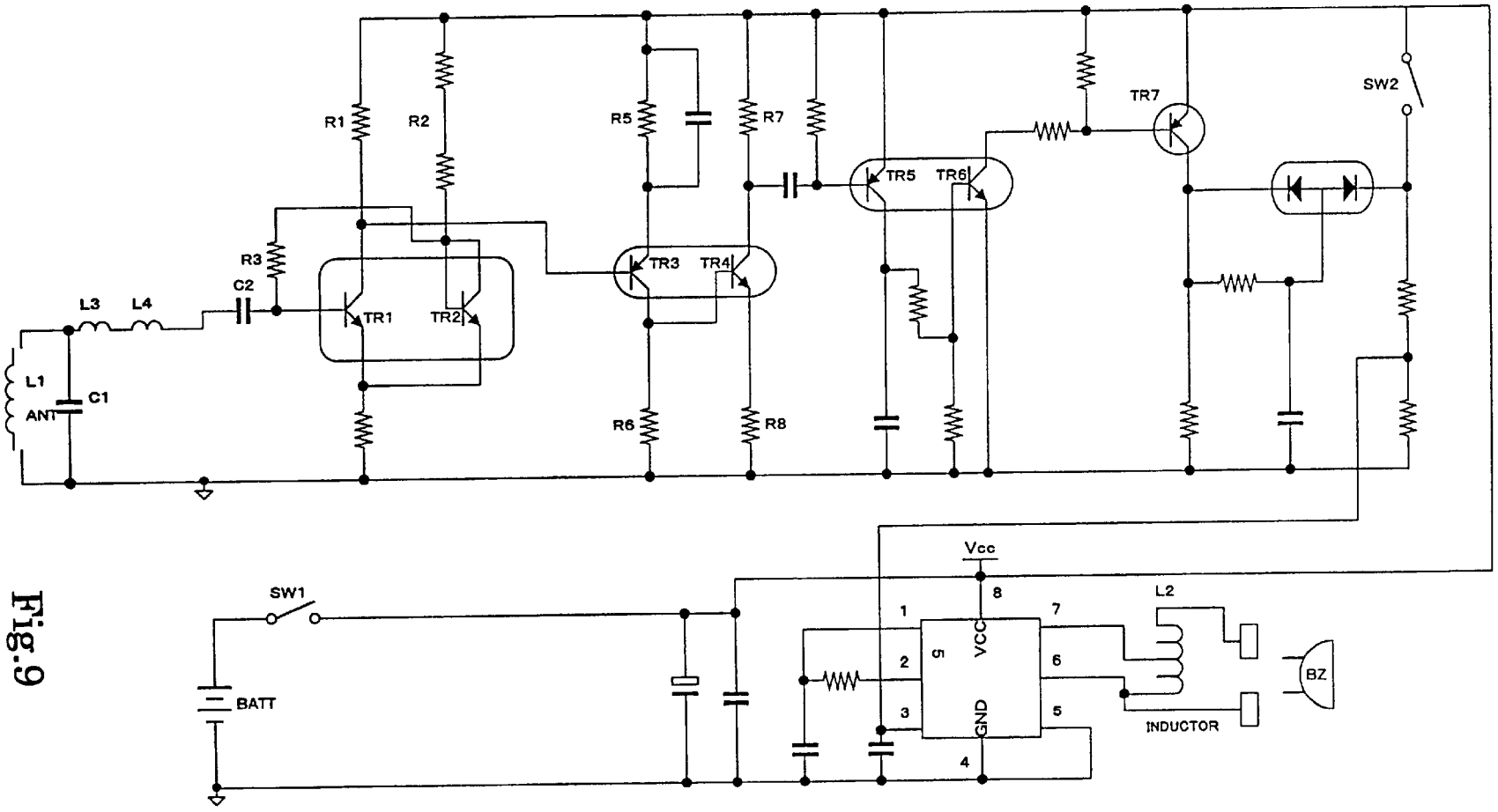
FIG. 9 shows the improved installation circuit of the receiving circuit used in the article surveillance security system with self-alarm according to this invention.
Figure 10:
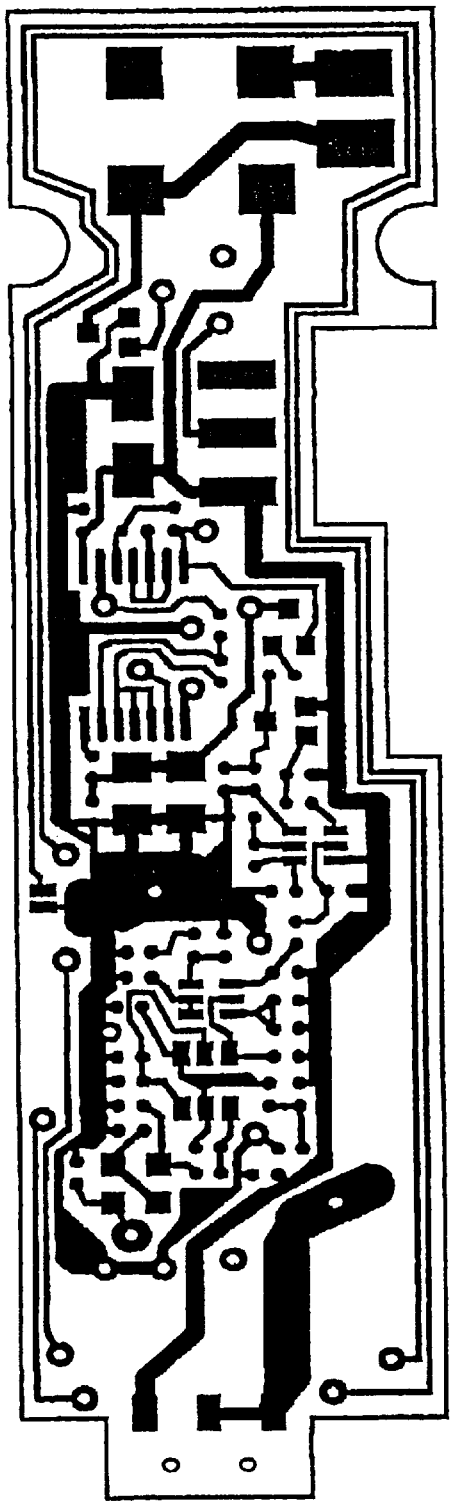
FIG. 10 shows the improved installation arrangement pattern of the receiving circuit used in the article surveillance security system with self-alarm according to this invention.

FIG. 9 shows an improved circuit according to this invention. FIG. 10 shows an improved installation arrangement of wiring pattern on the printed substrate (50 mm×16 mm) of the same size as that shown FIG. 8.

In FIG. 8, each chip parts are used at 1608 type of size, which is 1.6×0.8 mm. On the other hand, in the improved installation arrangement shown in FIG. 10, chip parts of 1005 type of size (1.0×0.5 mm) are used. When parts of the above described 1608 type of size are used, it is known that they are much affected by noise according to the experiment results. It is considered to be caused by the fact a magnitude of a distributed impedance related with distribution constant of each parts is in a comparative order with that of the load resistance (3 through 5 MΩ) of the first stage amplifier of this invention in a specification band (1 through 2 GHz) of a mobile telephone. This is an event caused by the case of an extremely large load resistance (3 through 5 MΩ). In the normal design, this event does not occur, and it can be usually ignored.

The important difference between the circuits shown in FIG. 7 and FIG. 9 is that the circuit shown in FIG. 9 contains inductance L3 and L4 inserted in series in the input circuit before the transistor TR1. The L3 and L4 have low impedance of the received radio wave at the frequency of 8.2 MHz according to this invention, and high impedance for the applicable frequency (1 or 2 GHz) of a mobile telephone. That is, together with the stray impedance naturally generated between the signal path and the earth, the L component functions as an LPF(low pass filter) to suppress the noise at frequency band (1 and 2 GHz) of a mobile telephone. In addition, the load resistance R1, the bias resistance R3, and the load resistance R2 of the transistor TR2 which is provided as a temperature compensation bias of the TR1, etc., are all installed using chip parts of 1005 type of size. Using the chip units of the 1005 type of size, the stray impedance of the chip units can be lower as compared with the chip units of, 1608 type of size. In addition, the shorter distance between the transistor and the earth or the power supply pattern reduces a stray impedance in the circuit, thereby acquiring double effects about a reduction of stray impedance. Since other transistor circuits TR3, TR4, etc. also are also installed using chip units of same size, the above described effect can be expected, but it is obvious that the S/N at the first stage of circuit is mostly contributed to noise reduction. At that, only the above described L3 and L4 are installed using 1608 type of size units because of the magnitude of the inductance. The amount of attenuation of by the L3 and L4 is equal to or higher than 3 dB (−3 through −20 dB) at 1.8 GHz.

The above described pattern of power supply and the earth pattern are designed as broadly as possible on the area of the printed substrate. Thus, the patterns situated above and below on the substrate surrounding the main circuit can generate a shielding effect.

When the installation area for the conventional printed substrate using the 1608 type of size is compared with the circuit installation area for the printed substrate of the 1005 type of size according to this invention, the area can be apparently halved by this invention. Therefore, the distance between the transistor and the earth or the power supply lines can similarly be shortened, thereby reducing the stray impedance. Actually, as a result of installing the circuit, the self-alarm tag according to this invention generates no erroneous operations against a mobile telephone, and has remarkably raised the reliability as an excellent self-alarm tag.

INDUSTRIAL APPLICABILITY

This invention has successfully provided a circuit to be possibly a product which is used for an article surveillance security system with self-alarm attached to articles or goods for protection against shoplifting in a common retail shop, etc., and is acceptable as a product operating somehow at an applicable frequency of 8.2 MHz with temperature compensation under the conditions of a very low level radio wave, and in the special operation state in the special usage in which the consumption of the power supply is extremely suppressed.

In addition, this invention has successfully realized a practical article surveillance security system with self-alarm operating at a frequency band of 8.2 MHz, for which conventional system has failed in developing a practical one up to today due to an erroneous operation by a mobile telephone, etc., by applying a noise removal circuit to the receiving circuit of the article surveillance security system with self-alarm which is used with a low level radio wave, indicates high impedance, and is easy subject to an influence of noise.

That is, a quite new self-alarm tag operating at 8.2 MHz can be realized by adding a device for protection against an erroneous operation by noise using a circuit configuration in which noise can be suppressed in the circuit of the self-alarm tag of 8.2 MHz as suggested above whose operation can be performed by the above described temperature compensation , etc. in a special operation state with a very low level received radio wave in the special usage in which the consumption of the power supply (operating current) is suppressed.

What is claimed is:

1. An article surveillance security system with self-alarm operating at from 6 through 10 MHz as a central frequency, receiving a low level radio wave swept within ±5 through 15% from the central frequency, and sounding an alarm, comprising: a tuning circuit tuning to the central frequency; and a differential amplifier amplifying and detecting an output of the tuning circuit, wherein: a load resistance of said differential amplifier is set to 3 through 5 MΩ, an operating current of said differential amplifier is set to 3 $\mu$A or less; and a base-emitter of an amplification/detection transistor (Tr1) of said differential amplifier are connected to a base-emitter of another diode-connected transistor (Tr2) of said differential amplifier to stabilize a bias drift by temperature.

2. The article surveillance security system with self-alarm as claimed in claim 1, wherein: the output of said differential amplifier is connected to a charge/discharge circuit including a pair of resistor and capacitor and a comparison circuit through a direct-coupled amplifier in series; and it is detected that receiving pulses corresponding to the sweep frequency have been supplied predetermined times, thereby removing the non-successive receiving noise around the central frequency.

3. The article surveillance security system with self-alarm as claimed in claim 1, wherein: the output of said differential amplifier is supplied to a microcomputer through a direct-coupled amplifier after analog-digital conversion; and it is detected that receiving pulses corresponding to the sweep frequency have been supplied predetermined times, thereby removing the non-successive receiving noise around the central frequency.

4. The article surveillance security system with self-alarm as claimed in one of claim 1 through 3, wherein; said central frequency is 8.2 MHz; said sweep range is ±10% from said central frequency; and said sweep frequency is 50 through 80 Hz.

5. An article surveillance security system with self-alarm operating at from 6 through 10 MHz as a central frequency, receiving a low level radio wave swept within ±5 through 15% from the central frequency, and sounding an alarm, comprising: a tuning circuit tuning to the central frequency, and a differential amplifier amplifying and detecting the output of the tuning circuit, wherein; an inductance having low impedance at 6 through 10 MHz, and high impedance at 1 GHz or more is inserted in series with a signal path before said differential amplifier having a high load resistance for amplifying and detecting the output of said tuning circuit supplied through the inductance.

6. The article surveillance security system with self-alarm as claimed in claim 5, wherein 1005 type of size parts are used as units of the resistance, the impedance, etc. in the circuit so that stray impedance at a frequency of 1 GHz or more in the input circuit, the bias circuit, and the load circuit of said differential amplifier can be as small as possible.

7. The article surveillance security system with self-alarm as claimed in claim 5 or 6, wherein a shield effect for external noise can be improved by widening an earth pattern and a pattern of power supply line in said circuit on a printed substrate.

8. The article surveillance security system with self-alarm as claimed in claim 5 or 6, wherein: said first stage amplifier is a differential amplifier; the load resistance of said differential amplifier is set to 3 through 5 MΩ, the operating current of said differential amplifier is set to 3 $\mu$A or less; and the base-emitter of the amplification/detection transistor (Tr1) of said differential amplifier are connected to the base-emitter of another diode-connected transistor (Tr2) of said differential amplifier to stabilize a bias drift by temperature.

9. The article surveillance security system with self-alarm as claimed in claim 8, wherein the output of said differential amplifier is connected to a charge/discharge circuit including a pair of resistor and capacitor and a comparison circuit in series through a direct-coupled amplifier; and it is detected that receiving pulses corresponding to the sweep frequency have been supplied predetermined times, thereby removing the non-successive receiving noise around the central frequency.

10. The article surveillance security system with self-alarm as claimed in claim 8, wherein: the output of said differential amplifier is supplied to a microcomputer through a direct-coupled amplifier after analog-digital conversion; and it is detected that receiving pulses corresponding to the sweep frequency have been supplied predetermined times, thereby removing the non-successive receiving noise around the central frequency.

11. The article surveillance security system with self-alarm as claimed in claim 5 or 6, wherein: said central frequency is 8.2 MHz; said sweep range can be ±10% from said central frequency; and said sweep frequency is 50 through 80 Hz.

* * * * *